United States Patent [19]

Griffiths

[11] 4,094,180

[45] June 13, 1978

[54] MULTIPLE STAGE WIRE DRAWING MACHINE

[75] Inventor: Evan Griffiths, Newington, Conn.

[73] Assignee: Amtel, Inc., Providence, R.I.

[21] Appl. No.: 798,266

[22] Filed: May 18, 1977

[51] Int. Cl.[2] ..... B21C 1/10; B21C 1/12

[52] U.S. Cl. ..... 72/280; 72/281; 72/289

[58] Field of Search ..... 72/278, 279, 280, 281, 72/289

[56] References Cited

U.S. PATENT DOCUMENTS

| | | | |
|---|---|---|---|
| 1,653,097 | 12/1927 | Hodgson | 72/289 |
| 1,737,345 | 11/1929 | Tideman | 72/289 |
| 1,866,142 | 7/1932 | Waters | 72/279 |
| 1,973,596 | 9/1934 | Yousey | 72/289 |
| 3,953,998 | 5/1976 | Braun | 72/289 |

FOREIGN PATENT DOCUMENTS

| | | | |
|---|---|---|---|
| 609 | 1914 | United Kingdom | 72/289 |

*Primary Examiner*—Michael J. Keenan
*Attorney, Agent, or Firm*—Prutzman, Hayes, Kalb & Chilton

[57] ABSTRACT

A multiple stage wire drawing machine having a final stage draw block and a plurality of multiple step draw capstan assemblies each having a plurality of coaxial draw capstans of increasing diameter rotatably mounted on a drive spindle, driven at a fixed angular rate relative to the final stage draw block, and independently driven by the spindle through friction disc slip couplings at substantially the same slip drive torque.

13 Claims, 2 Drawing Figures

MULTIPLE STAGE WIRE DRAWING MACHINE cl SUMMARY OF THE INVENTION

The present invention relates to multiple stage wire drawing machines of the slip type having at least one multiple step capstan with a plurality of draw capstans of increasing diameter for drawing a wire through respective drawing stage dies of decreasing diameter respectively.

It is a principal aim of the present invention to provide a new and improved multiple stage wire drawing machine of the type described providing improved wire cooling, longer die life, and higher drawing speeds.

It is another principal aim of the present invention to provide in a multiple stage wire drawing machine of the type described a new and improved draw capstan friction drive system which eliminates wire slip on the draw capstan and which provides for wrapping the wire about each draw capstan ten or fifteen or more wraps for substantially increasing wire cooling between drawing stages and substantially decreasing wire back-pull on each draw capstan. Because the wire back-pull T2 is inversely related to the number of wire wraps on the capstan (i.e., $T2 = T1/e^{u\theta}$ where T1 is the capstan draw tension; $e$ is the natural logarithm; $u$ is the coefficient of friction; and $\theta$ is the number of turns times $2\pi$) the back-pull can be substantially reduced, and therefore the likelihood of wire breakage can be substantially reduced, by increasing the number of wire wraps.

It is another aim of the present invention to provide a new and improved multiple stage wire drawing machine of the type described which produces higher quality wire.

It is a further aim of the present invention to provide a new and improved multiple stage wire drawing machine of the type described which can be threaded and run with minimum risk of wire breakage.

It is another aim of the present invention to provide a new and improved multiple stage wire drawing machine of the type described having an electric motor drive requiring less horsepower.

It is a further aim of the present invention to provide a new and improved multiple stage wire drawing machine of the type described capable of providing a larger number of wire drawing runs between downtime maintenance periods and providing for ready replacement of worn parts and minimum maintenance downtime.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
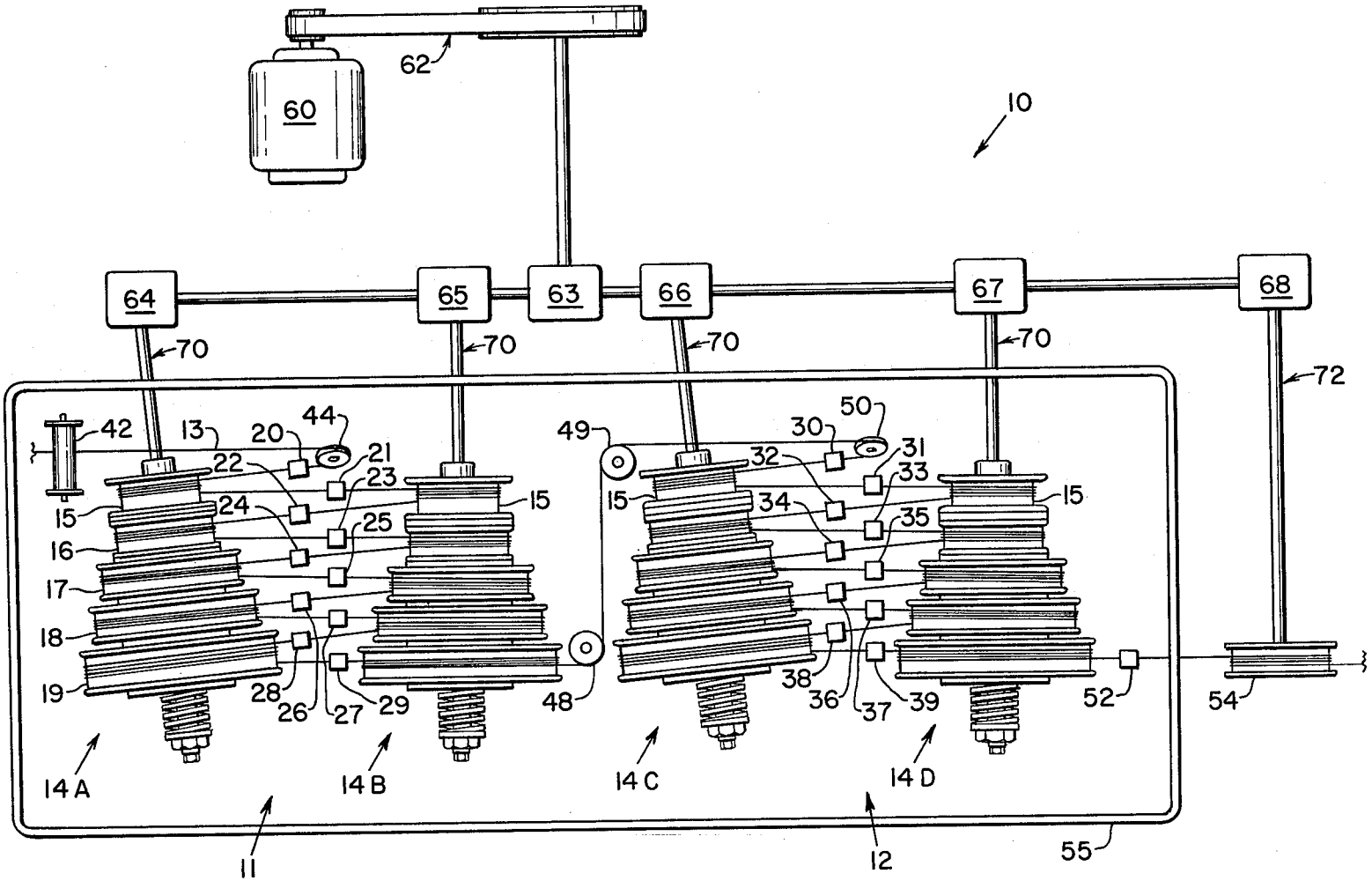
FIG. 1 is a generally diagrammatic top plan view of a multiple stage wire drawing machine incorporating an embodiment of the present invention.

Referring now to the drawings in detail wherein like numerals represent like parts, a multiple stage wire drawing machine 10 incorporating an embodiment of the present invention is shown having two pairs 11, 12 of multiple step capstan assemblies 14A, 14B and 14C, 14D respectively, each having five draw capstans or drums 15–19 of increasing diameter, and together providing a total of twenty draw capstans for drawing a wire 13 through twenty successive drawing stage dies 20–39 respectively. In a conventional manner, the twenty successive dies 20–39 have successively decreasing diameters for progressively drawing the wire to successively smaller sizes.

For machine thread-up and during machine operation, the wire 13 being drawn is fed to the first stage or smallest diameter draw capstan 15 of the first or lowest speed capstan assembly 14A via an idler roll 42, an idler pulley 44 and through the first stage die 20. The wire passes around the first stage capstan 15 and then through the second stage die 21 to the second stage or smallest diameter capstan 15 of the second or next lowest speed capstan assembly 14B. The wire passes around the second stage capstan 15 and then through the third stage die 22 to the third stage or second smallest diameter capstan 16 of the first capstan assembly 14A. In like manner, the wire is fed back and forth between the draw capstans of the first two capstan assemblies 14A, 14B for drawing the wire through the succeeding stage dies 23–39. The wire then passes from the tenth stage or largest diameter capstan 19 of the second capstan assembly 14B via three idler pulleys 48–50 through the eleventh stage die 30 to the eleventh stage or smallest diameter capstan 15 of the third capstan assembly 14C. The wire then passes back and forth between the third and fourth capstan assemblies 14C, 14D through the succeeding stage dies 31–39 in the same way the wire passes back and forth between the first pair 11 of multiple step capstan assemblies 14A, 14B. Finally, the wire is fed from the twentieth stage or largest diameter capstan 19 of the fourth capstan assembly 14D through a twenty-first or final stage die 52 to a final stage capstan or draw block 54. The wire is fed from the final stage capstan or draw block 54 for example for being coiled onto a suitable reel (not shown).

The relative diameters of the draw capstans 15–19 of each capstan assembly 14A–14D are preferably substantially inversely proportional to the wire or die size (i.e., the cross sectional area or square of the diameter of the wire or die) at the respective draw stages and so that the relative peripheral speeds of the draw capstans 15–19 are equal to the relative linear speeds of the wire at the respective draw stages when the draw capstans 15–19 are driven at the same angular rates of rotation.

The four capstan assemblies 14A–14D and final stage draw block 54 are connected by suitable gearing to be driven together by a variable speed electric drive motor 60 at fixed relative angular rates of rotation which reflects the increasing wire length as the wire passes through the successive drawing stages of the machine. For that purpose, the electric drive motor 60 is connected via a reduction belt drive 62 and suitable reduction gear boxes 63–68 to input drive shafts 70 of the capstan assemblies 14A–14D and to a drive shaft 72 to which the final stage draw block 54 is affixed. More particularly, the input shaft 70 of each multiple step capstan assembly is driven at a rotational rate relative to the final stage draw block 54 so that each draw capstan 15–19 thereon is driven to provide a peripheral or draw speed greater than that required by the peripheral or draw speed of the final stage capstan 54. Thus, based on the relative speeds of the drive shafts 70, 72, the peripheral speed $S_n$ of each stage draw capstan 15–19 is established to be greater than (and preferably a constant of for example approximately 10% greater than) that required by the peripheral speed $S_f$ of the final stage draw block 54 in accordance with the following formula:

$$S_n > S_f(D_n^2/D_f^2) \text{ or } S_n = CS_f(D_n^2/D_f^2)$$

where $D_n$ is the diameter of the die or wire at the drawing stage $n$ under consideration, $D_f$ is the diameter of the die or wire at the final drawing stage, and C is a constant of for example approximately 10% greater than unity (i.e., C = 1.10). The desired relative speeds of the drive shafts 70, 72 are then established in accordance with the desired relative peripheral speeds of the draw capstans 15–19 and final stage draw block 54.

Figure 2:
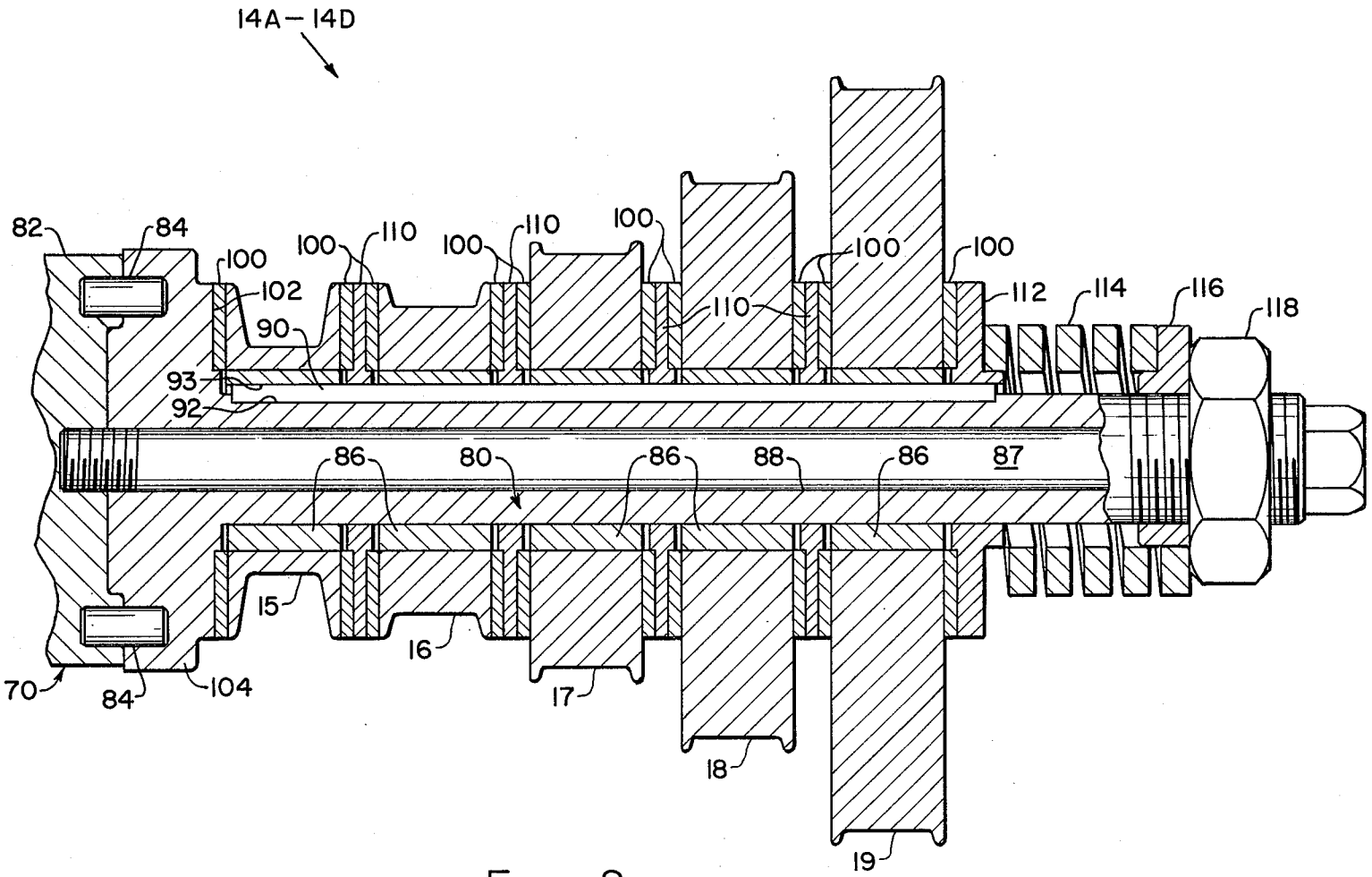
FIG. 2 is an enlarged longitudinal section view, partly broken away and partly in section, of a multiple step capstan assembly of the wire drawing machine.

Referring now particularly to FIG. 2, the input drive shaft 70 of each multiple step capstan assembly 14A–14D comprises a drive spindle 80 secured to a drive hub 82 by pins 84 and a bolt 87 extending through an axial bore 88 in the drive spindle 80 and threaded into the drive hub 82. The draw capstans 15–19 of each capstan assembly 14A–14D are mounted on the drive spindle 80 in axially spaced coaxial relationship and for independent rotation (and axial displacement to accommodate wear). A separate sleeve bearing 86 is mounted on the spindle 80 for each draw capstan 15–19, and the sleeve bearings 86 are keyed to the spindle 80 via an elongated key 90 mounted within axially extending keyways 92, 93 in the spindle 80 and bearing sleeves 86.

Each draw capstan 15–19 is coupled for being independently driven by the spindle 80 by a pair of friction slip couplings at the opposite axial ends of the draw capstan. For that purpose, a suitable annular friction disc 100, for example made of sintered bronze, is mounted between an axial end wall 102 of the enlarged inner end 104 of the spindle 80 and an inner axial end face of the smallest diameter draw capstan 15. Also, friction drive plates 110, 112 and annular friction discs 100 are provided between the opposed axial end faces of the axially spaced draw capstans 15–19 and at the outer end of the spindle 80 in engagement with the outer axial end face of the outer draw capstan 19. The friction drive plates 110, 112 are keyed to the spindle 80 by the elongated key 90 so that each draw capstan is independently frictionally driven by the spindle via a pair of friction slip couplings. Also, the draw capstans 15–19, friction drive plates 106, 108 and spindle 80 are preferably made of a suitable high grade steel and suitably hardened to minimize wear by the annular friction discs 100.

A helical compression coil spring 114 is mounted on the outer end of the spindle 80 between the outer friction drive plate 112 and a locating washer 116, and a spring adjustment nut 118 is mounted on a threaded outer end of the spindle 80 for adjusting the spring force biasing the assembly of coaxial draw capstans 15–19 and friction slip couplings together.

A wire 13 is preferably threaded to provide several turns and if desired up to ten turns or more about each draw capstan 15–19 of each capstan assembly 14A–14D to provide adequate wire cooling between the successive drawing dies 20–39 and 52 and to prevent wire slippage on the draw capstans. Also, the capstan assemblies 14A–14D and respective dies 20–39 are preferably mounted within a suitable oil bath tank 55 in a conventional manner for cooling the wire 13, dies 20–39 and the capstan assemblies 14A–14D of the machine. In addition to cooling, the oil bath provides for lubricating the wire and immersed capstan assemblies 14A–14D to facilitate the drawing process, reduce machine wear and ensure that the friction slip drive couplings between the capstan spindles 80 and draw capstans 15–19 provide designed slip drive torques not substantially effected by localized coupling heating.

Each capstan 15–19 of each multiple step capstan assembly 14A–14D is driven by the respective pair of slip drive couplings with a slip drive torque T in accordance with the formula:

$$T = Ffrn$$

where:

- $F$ is the axial spring force of the respective clutch spring 114;
- $f$ is the kinetic coefficient of friction provided by the friction discs 100;
- $r$ is the effective radius of the respective pair of annular friction discs 100; and
- $n$ is the number of slip drive couplings employed for driving the capstan; i.e., 2 in the shown embodiment.

During the normal operation of the machine, the slip drive couplings driving each capstan is continuously slipping because, as previously described, the capstan input shaft 70 is attempting to rotate the capstan at an angular rate of rotation which is greater than and preferably a constant of for example 10% greater than the angular rate of rotation required. Accordingly, a kinetic coefficient of friction $f$ is used to calculate the applied torque.

Although the relative slip drive torques for driving the capstans 15–19 of each capstan assembly 14A–14D can be selectively established by the selection of annular friction discs with different effective radii or made of material with different kinetic coefficients of friction, it has been found desirable to use a substantially constant slip drive torque for driving the capstans 15–19 of each capstan assembly. Also, a progressively decreasing slip drive torque is employed in the successive capstan assemblies 14A–14D because of the progressively decreasing wire size. Accordingly, in each capstan assembly 14A–14D the friction drive couplings are preferably functionally the same and the annular friction discs 100 are preferably the same size and made of the same material.

As previously indicated, in each capstan assembly 14A–14D the diameters of the draw capstans 15–19 are preferably inversely proportional to the cross sectional area of the wire wound thereon. Therefore, by using a substantially constant slip drive torque within each capstan assembly, it can be seen that the wire drawing stress at each corresponding drawing stage will be substantially the same in accordance with the following formula:

$$\text{Wire Stress} = \frac{\text{Slip Drive Torque}}{\text{Capstan Diameter} \times \text{Wire Area}}$$

The slip drive torque established by the adjustment of the force of the compression spring 114 of each capstan assembly is set to provide a wire stress at the corresponding plurality of drawing stages which is less than the breaking stress of the wire being drawn and yet which is sufficient to draw the wire through the corresponding stage dies. Thus, the spring force of each capstan assembly is set in accordance with the wire sizes at the corresponding drawing stages and the stress/-strain characteristics of the wire being drawn and to establish a friction slip torque sufficient to draw the wire but without breaking the wire.

Assuming an approximately 2:1 relationship between the static and kinetic coefficients of friction of the annular friction discs 100, the initial static start-up drive torque when starting the machine for a drawing run and for thread-up (during which the wire is fed through the dies and around the draw capstans in succession) will be approximately twice the running or slip drive torque. However, as the required running or slip drive torque is typically about 30–40% of the wire breaking torque at each drawing stage (and the wire reduction at each drawing stage is established to ensure that the required running or slip drive torque is less than 50% and preferably no greater than 40% of the wire breaking torque) the static drive torque at each drawing stage is established to be less than the wire breaking torque at that stage. Consequently, the friction drive couplings provided for driving each capstan will slip before the start-up static drive torque will break the wire. Thus, during start-up and thread-up, the friction drive couplings will begin slipping as soon as the machine starts running.

As previously indicated, the peripheral speed of each stage draw capstan 15–19 relative to the peripheral speed of the final stage draw block 54 (based on the relative speeds of their drive shafts 70, 72) is preferably established to be a constant of for example approximately 10% amount greater than the required speed and whereby all twenty draw capstans 15–19 will have a constant percentage angular slip relative to their drive shafts 70. The constant percentage slip of each draw capstan 15–19 is established to accommodate die wear and to ensure that all of the draw capstans 15–19 are continuously slipping during a drawing run. The constant percentage slip (established by the gear ratios of the reduction gear boxes 63–68) is preferably established at a minimum practical level so that the required friction horsepower is held to a minimum.

In operation, the draw capstans 15–19 are driven with slip drive torques providing a substantially constant wire drawing stress which is sufficient to draw the wire through their respective dies but insufficient to break the wire. Thus, if for any reason, there is a hang-up at any stage in the multiple stage drawing process, each succeeding stage draw capstan 15–19 will merely slip and not break the wire. Also, each prior stage draw capstans, even where there are ten or more wraps in the coil of wire wound thereon, will be ineffective in drawing the wire because the wire coil thereon will loosen or expand to uncouple the capstan from the wire coil. Accordingly, any hang-up during threading the machine would not cause wire breakage. Also, any hang-up during a drawing run would cause wire breakage only at the final stage draw block 54 and so that a complete machine re-threading would be unnecessary.

Thus, it can be seen that the multiple stage wire drawing machine of the present invention provides for increasing wire cooling between drawing stages and improving the quality of the drawn wire. Also, with the improved multiple stage wire drawing machine of the present invention, higher drawing speeds and longer die life are attainable. Further, the required slip horsepower component and therefore the total required horsepower is minimized. And, during machine thread-up, the possibility of wire breakage is substantially eliminated and during a machine run, any possible wire breakage is substantially localized.

As will be apparent to persons skilled in the art, various modifications, adaptations and variations of the foregoing specific disclosure can be made without departing from the teachings of the present invention.

I claim:

1. In a multiple stage wire drawing machine having at least one pair of rotatable multiple step capstan assemblies, each having an input drive shaft and a plurality of draw capstans of increasing diameter, in aligned generally parallel relationship for drawing a wire back and forth through successive wire drawing stages respectively, a final stage draw capstan for a final wire drawing stage, a plurality of drawing dies of decreasing die diameter for said successive and final drawing stages respectively for drawing a wire to successively smaller sizes respectively, a machine drive motor, and transmission means connecting the drive motor to the input drive shaft of each multiple step capstan assembly and to the final stage draw capstan for driving the input drive shafts and the final stage draw capstan at fixed relative angular rates of rotation in accordance with the relative diameters of the respective draw capstans and the dies at the respective drawing stages, the improvement wherein the plurality of draw capstans of increasing diameter of each multiple step capstan assembly are independently rotatably mounted on the respective input drive shaft in axially spaced coaxial relationship, and wherein each multiple step capstan assembly comprises adjustable slip coupling means providing a slip drive between the respective input drive shaft and each draw capstan rotatable thereon for driving the capstan with an established slip drive torque, the adjustable slip coupling means being adjustable for establishing the slip drive torques between the input drive shaft and the draw capstans respectively.

2. A multiple stage wire drawing machine according to claim 1 wherein the adjustable slip coupling means of each capstan assembly provides a friction slip drive between the respective input drive shaft and each draw capstan rotatable thereon and comprises adjustable spring means for adjustably establishing the friction slip drive torques between the input drive shaft and the draw capstans respectively.

3. A multiple stage wire drawing machine according to claim 1 wherein the slip coupling means of each capstan assembly connects the draw capstans to the input drive shaft for being driven thereby with approximately the same established slip drive torques.

4. A multiple stage wire drawing machine according to claim 1 wherein the slip coupling means of each capstan assembly comprises a plurality of friction drive plates mounted on the respective input drive shaft coaxially with and for frictional engagement with the axially spaced draw capstans, the draw capstans having friction surfaces engaging the friction drive plates to provide a friction slip coupling therebetween and means connecting the friction plates to the input drive shaft for being driven thereby.

5. A multiple stage wire drawing machine according to claim 4 wherein the draw capstans and friction drive plates of each capstan assembly are mounted for axial displacement on the input drive shaft and wherein the adjustable slip coupling means of each capstan assembly comprises spring means biasing the respective assembly of coaxial friction plates and draw capstans together for establishing the friction slip coupling torque transmitted therebetween.

6. A multiple stage wire drawing machine according to claim 5 wherein the spring means of each capstan assembly comprises a compression coil spring generally coaxially mounted on the respective input drive shaft for axially forcing the assembly of coaxial friction plates and draw capstans together, and wherein the coupling means of each capstan assembly comprises an adjustment nut threadedly mounted on the respective input drive shaft for axially adjusting the compression coil spring for adjusting its axial spring force on the assembly of coaxial friction plates and draw capstans.

7. In a multiple stage wire drawing machine having at least one rotatable multiple step capstan assembly having an input drive shaft and a plurality of draw capstans of increasing diameter for drawing a wire through succeeding wire drawing stages respectively, a final stage draw capstan for a final wire drawing stage, a plurality of drawing dies of decreasing die diameter for said succeeding and final drawing stages respectively for drawing a wire to smaller diameters respectively, a machine drive motor, and transmission means connecting the drive motor to the input drive shaft of each multiple step capstan assembly and to the final stage draw capstan for driving each input drive shaft and the final stage draw capstan at fixed relative angular rates of rotation in accordance with the relative diameters of the respective draw capstans and the dies at the respective drawing stages, the improvement wherein the plurality of draw capstans of increasing diameter of each said multiple step capstan assembly are independently rotatably mounted on the respective input drive shaft in axially spaced coaxial relationship, and wherein each said multiple step capstan assembly comprises adjustable slip coupling means providing a slip drive between the respective input drive shaft and each draw capstan rotatable thereon for driving the capstan with an established slip drive torque, the adjustable slip coupling means being adjustable for establishing the slip drive torques between the input drive shaft and the draw capstans respectively.

8. A multiple stage wire drawing machine according to claim 7 wherein the slip coupling means of each capstan assembly comprises a plurality of friction drive plates mounted on the respective input drive shaft coaxially with and for frictional engagement with the axially spaced draw capstans, the draw capstans having friction surfaces engaging the friction drive plates to provide a friction slip coupling therebetween and means connecting the friction plates to the input drive shaft for being driven thereby.

9. A multiple stage wire drawing machine according to claim 8 wherein the draw capstans and friction drive plates of each capstan assembly are mounted for axial displacement on the input drive shaft and wherein the adjustable slip coupling means of each capstan assembly comprises spring means biasing the respective assembly of coaxial friction plates and draw capstans together for establishing the friction slip coupling torque transmitted therebetween.

10. In a multiple stage wire drawing machine having at least one rotatable multiple step capstan assembly having an input drive shaft and a plurality of draw capstans of increasing diameter for drawing a wire through succeeding wire drawing stages respectively, the improvement wherein the plurality of draw capstans of increasing diameter of the multiple step capstan assembly are independently rotatably mounted on the respective input drive shaft in axially spaced coaxial relationship, and wherein the multiple step capstan assembly comprises adjustable slip coupling means providing a slip drive between the capstan assembly input drive shaft and each draw capstan rotatable thereon for driving the draw capstan with an established slip drive torque, the adjustable slip coupling means being adjustable for establishing the slip drive torques, in accordance with a predetermined slip drive torque relationship, between the input drive shaft and the plurality of rotatable draw capstans respectively.

11. In a multiple stage wire drawing machine having at least one rotatable multiple step capstan assembly with an input drive shaft and a plurality of draw capstans of increasing diameter for a plurality of succeeding wire drawing stages respectively, a final stage draw capstan for a final wire drawing stage, a plurality of drawing dies of decreasing die diameter for said succeeding and final drawing stages respectively for drawing a wire to successively smaller diameters respectively, a machine drive motor, and transmission means connecting the drive motor to the input drive shaft of each multiple step capstan assembly and to the final stage draw capstan for driving each input drive shaft and the final stage draw capstan at fixed relative angular rates of rotation, the improvement wherein the plurality of draw capstans of increasing diameter of each said multiple step capstan assembly are independently rotatably mounted on the respective input drive shaft in axially spaced coaxial relationship, and wherein each said multiple step capstan assembly comprises slip coupling means providing a slip drive between the respective input drive shaft and each draw capstan thereon for driving the capstan with an established slip drive torque, the plurality of draw capstans of increasing diameter having relative diameters substantially inversely proportional to the square of the wire diameter of the respective wire drawing stages whereby the draw capstans have substantially the same angular slip relative to the input drive shaft.

12. A multiple stage wire drawing machine according to claim 11 wherein the transmission means drives each input drive shaft and the final stage draw capstan at a relative rate providing a constant slippage of each draw capstan relative to its input drive shaft of approximately 10%.

13. In a multiple stage wire drawing machine having at least one rotatable capstan assembly with an input drive shaft and a plurality of draw capstans for a plurality of succeeding wire drawing stages respectively, a final stage draw capstan for a final wire drawing stage, a plurality of drawing dies of decreasing die diameter for said succeeding and final drawing stages respectively for drawing a wire to successively smaller diameters respectively, a machine drive motor, and transmission means connecting the drive motor to the input drive shaft of each multiple step capstan assembly and to the final stage draw capstan for driving each input drive shaft and the final stage draw capstan at fixed relative angular rates of rotation, the improvement wherein the plurality of draw capstans of each capstan assembly are independently rotatably mounted on the respective input drive shaft in axially spaced coaxial relationship, and wherein each said capstan assembly comprises slip coupling means providing a slip drive between the respective input drive shaft and each draw capstan thereon for driving the capstan with an established slip drive torque providing an approximately constant wire stress at said plurality of succeeding wire drawing stages.

* * * * *